United States Patent [19]

Compton et al.

[11] 4,231,476

[45] Nov. 4, 1980

[54] PLASTICS CONTAINERS

[75] Inventors: Peter A. Compton; John G. Wood, both of Kings Lynn, England

[73] Assignee: Mars Limited, London, England

[21] Appl. No.: 53,814

[22] Filed: Jul. 2, 1979

Related U.S. Application Data

[63] Continuation of Ser. No. 889,596, Mar. 23, 1978, abandoned, which is a continuation of Ser. No. 812,076, Jul. 1, 1977, abandoned, which is a continuation of Ser. No. 810,827, Jun. 28, 1977, abandoned.

[51] Int. Cl.[3] ..... B65D 21/02; B65D 77/04

[52] U.S. Cl. ..... 206/519; 206/217; 206/520; 229/1.5 B

[58] Field of Search ..... 206/217, 519, 520; 229/1.5 B; 220/72

[56] References Cited

U.S. PATENT DOCUMENTS

| | | | |
|---|---|---|---|
| 2,563,352 | 8/1951 | Mores | 206/519 |
| 2,667,423 | 1/1954 | Simpson | 206/217 |
| 2,899,098 | 8/1957 | Gits | 229/1.5 B |
| 3,169,689 | 2/1965 | Schwartz | 229/1.5 B |
| 3,495,733 | 2/1970 | Davis | 229/1.5 B |
| 3,749,276 | 7/1973 | Davis | 206/519 |
| 3,825,166 | 7/1974 | Padovani | 229/1.5 B |

FOREIGN PATENT DOCUMENTS

| | | | |
|---|---|---|---|
| 1044009 | 11/1953 | France | 206/519 |
| 1264474 | 2/1972 | United Kingdom | 206/519 |
| 1366310 | 9/1974 | United Kingdom | 229/1.5 B |
| 1395026 | 5/1975 | United Kingdom | 206/519 |

*Primary Examiner*—George E. Lowrance

*Attorney, Agent, or Firm*—Curtis, Morris & Safford

[57] ABSTRACT

A nestable container in which identical containers are held together in a stack by holding means. The holding means comprise axially extending ribs on the outside of the container which engage a cylindrical surface on the inside of the container to hold the container together in the stack by friction.

17 Claims, 3 Drawing Figures

PLASTICS CONTAINERS

This is a continuation of application Ser. No. 889,596, filed Mar. 23, 1978, which is a continuation of Ser. No. 812,076, filed July 1, 1977, now abandoned, which is a continuation of application Ser. No. 810,827, filed June 28, 1977, now abandoned.

The present invention relates to plastics containers for use in vending machines and particularly to containers which can be nested, one inside another to form a stack in which the bottom walls of each pair of adjacent containers are spaced apart and the spaces between adjacent bottom walls contain dry ingredients for a beverage and are sealed by abutment of parts of the respective containers.

Such containers may be used in automatic vending machines where the containers are separated individually from a stack and automatically filled with water to make a beverage when the machine is operated. They may also be used in the home where they are separated and filled with water by hand.

In known containers of this kind the wall of the container is provided on its inside with an annular projection and on its outside with an annular groove, the groove being disposed below the projection. When the containers are fitted together in a stack, the annular projection of each container interlocks with the annular groove of the container next above it so as to secure the containers to one another. When such containers are brought together to form a stack and when they are separated, the walls of the containers are deflected radially to allow the annular projection to pass over the wall of the container adjacent the groove.

The present invention is concerned to provide an alternative arrangement for holding the cups together in the stack.

According to the present invention there is provided a nestable container of resilient plastics material comprising bottom and side walls, the side wall diverging generally upwardly from the bottom wall to the lip, the container having surfaces which form stops and seals to limit the extent to which identical such containers can be nested one inside another and form a sealed space between the bottom walls of the containers, the container having holding means for releasably holding identical such containers together when nested, the holding means comprising axially extending ribs so arranged as to engage the side wall of an identical container when the containers are nested to hold the containers together by frictional engagement. Preferably the crests of the ribs are substantially the same distance from the axis of the container throughout a significant part of their axial length, or the part of the surface of the container which is engaged by the ribs of the identical container when nested is substantially cylindrical or both, so that the ribs and the surface are in frictional engagement not only when the containers are fully nested but throughout the final part of the movement of the containers towards one another when they are being nested.

By suitable choice of the thickness, height, and number of ribs the frictional force between the containers when the containers are nested can be adjusted to provide sufficient friction to hold the containers firmly together and yet allow the containers to be easily separated intentionally by an axial force. The ribs may be sufficiently thin and high to be flexed in the radial direction when the containers are nested. By making the containers of a resilient plastics material such as polypropylene which does not "relax" when maintained under deformation the ribs will maintain a constant frictional force against the surface of the adjacent container.

Preferably the ribs are formed on the outside of the side wall of the container. By placing sufficient ribs in a suitable position towards the top of the containers they may also serve to provide additional insulation where the container is gripped by the user so that the container is more comfortable to hold when it contains a very hot beverage.

The stops and the seals may be formed by the same surfaces. For example they may be provided by a continuous internal shoulder on the side wall of the container near its bottom which abuts a continuous foot extending around the periphery of the bottom wall formed by a downwards extension of the side wall of an identical container or a shoulder formed at the periphery of the bottom of the container where it meets the side wall. Abutment of the foot with the shoulder serves both to limit the axial extent to which identical containers can be nested one inside the other and to serve as a seal for the space between the bottom walls of the containers.

Alternatively the stops and the seals may be provided by different surfaces. For example the stops may be provided by a series of internal projections distributed around the inside of the container near its bottom and either a shoulder formed at the periphery of the bottom of the container where it meets the side wall of a foot formed by a downward extension of the side walls beyond the bottom wall of the container. The sealing surfaces may be provided by an outer surface of the side wall of the container and an inner surface of the side wall of an identical container which make wiping contact when the containers are nested together.

An embodiment of the invention will now be described, by way of example, with reference to the accompanying drawings, in which.

Figure 1:
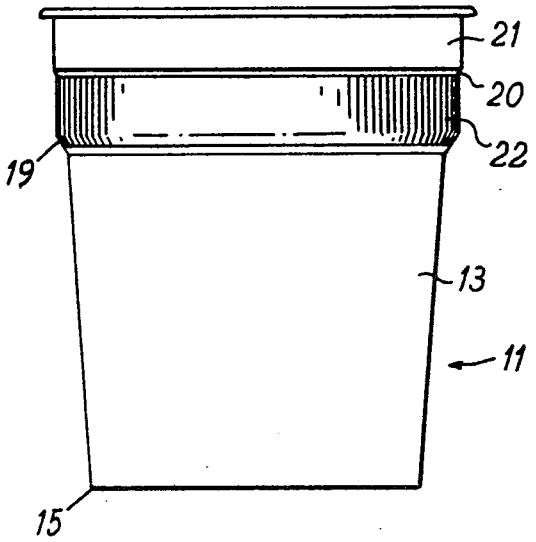
FIG. 1 is a side elevation of a container according to the invention.
Figure 3:
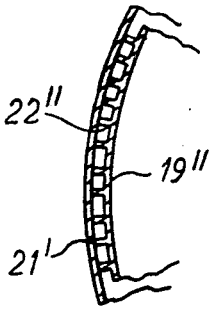
FIG. 3 is a fragmentary cross section on the line III—III in FIG. 2.
Figure 2:
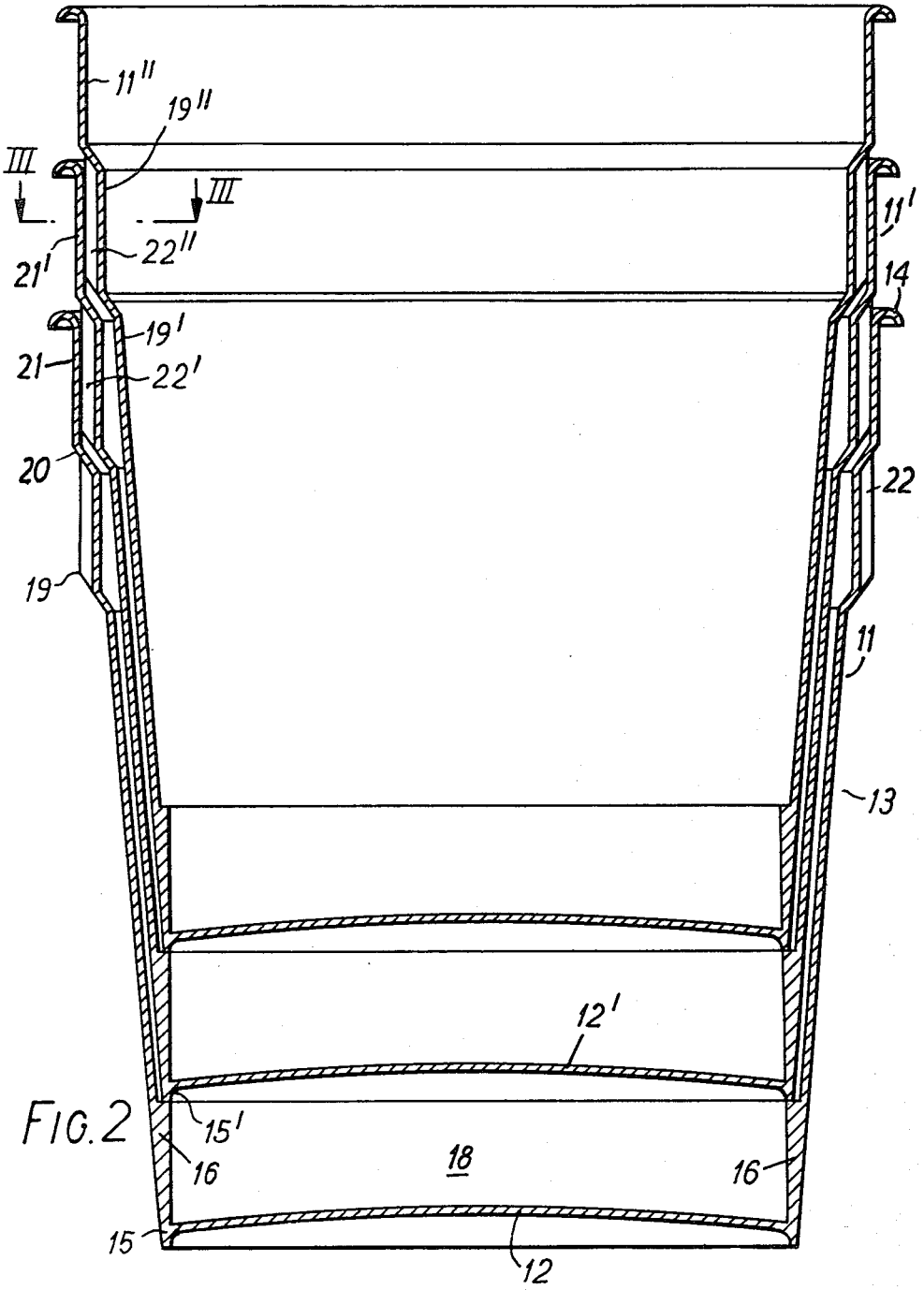
FIG. 2 is an enlarged vertical cross section showing three containers nested one inside another.

Referring to the drawings, these show a cup 11 formed of polypropylene by injection moulding. The cup 11 comprises a bottom wall 12 which is bowed upwardly, and a side wall 13. The side wall 13 diverges from the bottom to the top where it terminates in a lip 14 which is curved outwardly and downwardly. A downwardly projecting extension of the side wall below the bottom wall provides a foot 15 on which the cup stands. The lower portion of the side wall increases in thickness from the bottom wall 12 up to a shoulder 16. When an identical cup 11' is nested inside the cup 11, the foot 15' abuts the shoulder 16 to limit the extent to which the cups can be nested together and to seal the space 18 between the adjacent bottom walls 12 and 12' of the cups.

Above the shoulder 16 the side wall 13 of the cup continues upwardly and outwardly to a cylindrical region 19. Above the region 19 is a region 20 of the side wall which extends upwardly and outwardly. A region 21 above the region 20 and below the lip 14 is also cylindrical. A small internal bead extending around the internal periphery of the cup may be formed in the region of the lip 14 to provide a slight undercut so that when the moulds are separated after forming the cup the cup remains on the male mould member.

On the outside of the cup in the region 19 are axially extending ribs 22. The crests of the ribs extend parallel to the axis of the cup so that they are a uniform distance from the axis of the cup throughout their length. The outside diameter of the ribs is slightly greater than the internal diameter of the cup in the cylindrical region 21. When the cup 11' is nested inside the cup 11 and the foot 15 is abutting the stops 17 the ribs 22' engage the inside of the region 21 of the cup 11. The height, thickness and number of ribs 22' is such that the frictional forces between the ribs 22' and the side wall of the cup 11 in the region 21 are sufficient to hold the cups together.

An alternative way of increasing the force that has to be applied to separate the cups is to provide between each alternate pair of adjacent ribs, a pair of projections which extend from the ribs circumferentially towards one another. On the inside of the cup wall is a row of studs. The width of the studs is slightly greater than the gap between the two projections of each pair so that when the cups are nested the studs pass up between the ribs, flexing the ribs circumferentially as the studs pass through the gap between the projections, and engaging behind the projections to assist in holding the cups together in a nested configuration. To facilitate removal of the cups from the mould, the projections may be provided only on the ribs in two diametrically opposite zones of the cup. The parts of the mould which form these zones may then be retractable to allow the undercuts on the cups, formed by the projection, to clear the mould wall.

We claim:

1. A nestable container at least partially of resilient plastics material comprising:

a bottom wall;

a side wall having an outside and an inside surface and diverging generally upwardly from the bottom wall;

stop and seal surfaces to limit the extent to which identical containers can be nested one inside another and form a sealed space between the bottom walls of nested containers;

holding means for releasably holding identical containers together when nested, the holding means comprising axially extending ribs disposed on one surface of the side wall and a substantially cylindrical surface on the other surface of the side wall, the axially extending ribs being so arranged to engage the substantially cylindrical part of the side wall of an identical container when the containers are nested to hold the containers together by frictional engagement, the axially extending ribs having crests which are substantially the same distance from the axis of the container throughout a significant part of their axial length, and the radius of the cylindrical surface being a different dimension than the distance of the crests from the axis so as to form a slight interference fit with a mating cylindrical surface of a nested container and the wall being deformable so that the cylindrical portion can engage the portion with the ribs.

2. A container according to claim 1, wherein the ribs are formed on the outside surface of the side wall of the container.

3. A container according to claim 2, wherein the ribs are disposed on the upper half of the container.

4. A container according to claim 1 wherein the stop and seal surfaces are formed by the same surfaces.

5. A container according to claim 4 wherein the stop and seal surfaces comprise a continuous internal shoulder on the inside surface of the side wall of the container near its bottom wall and a continuous abutment surface disposed around the periphery of the bottom wall, the continuous abutment surface of one container abutting the internal shoulder of an identical container when the containers are nested.

6. A container according to claim 1 in which the stop and seal surfaces are provided by different surfaces.

7. A container according to claim 6 in which the stop surfaces are provided by a series of internal projections distributed about the inside of the container near its bottom and a continuous abutment surface on the outside of the container disposed around the periphery of the bottom wall of the container.

8. A container according to claim 6 in which the seal surfaces are provided by an outer surface of the side wall of the container and an inner surface of the side wall of an identical container which make wiping contact when the containers are nested together.

9. A container according to claim 1 in which the bottom and side walls are formed as a single-piece molding of plastics material.

10. A container according to claim 1 in which the container is formed by injection molding.

11. A container according to claim 1 in which the container is fabricated of polypropylene.

12. A container according to claim 1 in which the container has an undercut on the inside adjacent the lip.

13. A container according to claim 5 including a shoulder formed at the periphery of the bottom wall where it meets the side wall, the shoulder comprising the continuous abutment surface.

14. A container according to claim 5 including a foot extending around the periphery of the bottom wall and formed by a downward extension of the side wall, the foot comprising the continuous abutment surface.

15. A container according to claim 7 including a shoulder formed at the periphery of the bottom wall where it meets the side wall, the shoulder comprising the continuous abutment surface.

16. A container according to claim 15 including a foot extending around the periphery of the bottom wall and formed as a downward extension of the side wall, the foot comprising the continuous abutment surface.

17. A stack of containers formed by nesting a plurality of containers each in accordance with claim 1, further comprising dry ingredients for a beverage in the spaces between the bottom walls of adjacent pairs of containers.

* * * * *